US007334587B2

(12) United States Patent
Lake

(10) Patent No.: US 7,334,587 B2
(45) Date of Patent: Feb. 26, 2008

(54) FLUID CONTAINMENT ASSEMBLY FOR USE IN HYDROBLAST CLEANING

(75) Inventor: John W. Lake, Bakersfield, CA (US)

(73) Assignee: Western Oilfields Supply Co., Bakersfield, CA (US)

( * ) Notice: Subject to any disclaimer, the term of this patent is extended or adjusted under 35 U.S.C. 154(b) by 316 days.

(21) Appl. No.: 11/141,146

(22) Filed: May 31, 2005

(65) Prior Publication Data

US 2006/0266390 A1 Nov. 30, 2006

(51) Int. Cl.
*B08B 9/28* (2006.01)
*B08B 9/093* (2006.01)

(52) U.S. Cl. ..... 134/22.1

(58) Field of Classification Search ..... 134/104.2, 134/22.1

See application file for complete search history.

(56) References Cited

U.S. PATENT DOCUMENTS

RE26,674 E * 9/1969 Fitzwilliam ..... 222/570
4,975,992 A * 12/1990 Patterson et al. ..... 4/599
6,315,495 B1 * 11/2001 Starheim ..... 405/129.8
6,394,171 B1 * 5/2002 Robbins, III ..... 160/184
6,990,987 B1 * 1/2006 Smith ..... 134/22.1
2003/0218333 A1 * 11/2003 Barber et al. ..... 285/124.1
2004/0149341 A1 * 8/2004 Driver ..... 138/98
2005/0217748 A1 * 10/2005 Ikegami ..... 139/388

* cited by examiner

*Primary Examiner*—Michael B. Cleveland
*Assistant Examiner*—Samuel A Waldbaum
(74) *Attorney, Agent, or Firm*—Holland & Knight LLP; Richard E. Lyon, Jr.

(57) ABSTRACT

An assembly for use in the collection and disposal of water and debris during the hydroblast cleaning of a heat exchanger including a containment shield having an end portion and an annular portion mounted adjacent one end of the heat exchanger such that the annular portion circumscribes the area between the end of the heat exchanger and the end portion of the shield and a flexible waterproof shroud disposed about the containment shield for collecting water and debris generated during the hydroblast cleaning and directing same to a collection location. Optionally, an energy absorbent element can be mounted adjacent said one end of the heat exchanger. A portable washing and back spray collection station is optionally positioned about the upstream end of the heat exchanger.

23 Claims, 4 Drawing Sheets

FLUID CONTAINMENT ASSEMBLY FOR USE IN HYDROBLAST CLEANING

BACKGROUND OF THE INVENTION

The present invention is directed to an assembly for use in hydroblast cleaning and, in particular, the hydroblast cleaning of heat exchangers. A typical heat exchanger comprises an outer shell or housing, generally cylindrical, through which a plurality of individual fluid carrying tubes extend. The tubes are typically formed of a heat conductive material such that heat can be exchanged between the fluids flowing through the tubes and fluid flowing about the tubes. During use, heat exchangers become fouled with scale and debris and their efficiency is reduced. Cleaning of such devices typically includes the use of a hydroblasting process in which the interior of the heat exchanger tubes are subjected to a low volume but extremely high velocity water spray. The spray or jets of water generated during hydroblasting may generate several thousand pounds of force. Typically, the hydroblast cleaning of heat exchangers requires the exchanger to be removed from the process area and taken to a cleaning area, usually a large concrete pad where the exchangers are subjected to hydroblast cleaning. The water and debris driven from the heat exchanger are contained on the concrete pad and collected in a sump. The process sprays a considerable amount of water about the surrounding area and generally creates a mess. It would be highly desirable to provide an assembly for use in the hydroblast cleaning of such devices that could better contain the high velocity water and debris extracted therefrom for collection and disposal. It would also be highly desirable if such a system allowed heat exchangers to be cleaned in place. Such a system would not only avoid the mess created with the hydroblast cleaning process but also would result in a substantial savings of time and expense in connection with the cleaning of typical heat exchangers.

SUMMARY OF THE INVENTION

Briefly, the present invention comprises an assembly for use in the hydroblast cleaning of heat exchangers. The assembly includes an end shield that is spaced from and axially aligned with the downstream end of the heat exchanger and an annular shield that surrounds the area between the end shield and the end of the heat exchanger. The end shield and annular shield cooperate to substantially contain the exiting spray and the debris driven from the heat exchanger tubes. An energy absorbing element may be mounted adjacent the downstream end of the heat exchanger for reducing the force of the extremely high velocity jets of water exiting the heat exchanger tubes. A waterproof flexible shroud is disposed about the shield portions of the assembly, the energy absorbing element and the downstream end of the heat exchanger. An aperture is provided in the underside of the annular shield so that the water and debris collected therein will drain into the shroud. A nozzle is provided in the lower portion of the shroud for draining the water and debris into a detachable hose or a portable collection device positioned on the ground below the shroud.

The portable collection device employed in the present invention is preferably is formed of a flexible and durable plastic material and defines a bottom surface, upstanding perimeter wall portions which are moveable between upright and folded positions and foldable support members. As a result of its configuration, the device can be readily folded into a compact disposition for travel and storage or disposed on the ground in an open upstanding position for collecting the spray and debris from the hydroblast cleaning of the heat exchanger tubes.

A portable washing station also is preferably provided for collecting any back spray and debris at the upstream end of the heat exchanger where the worker directs the high velocity water spray into the heat exchanger tubes. The station is positioned about the upstream end of the heat exchanger and houses both the upstream end of the heat exchanger and the person conducting the hydroblast cleaning. The washing station comprises a horizontal waterproof flooring having flexible side walls, a raised floor support, preferably in the form of a grid walkway which supports the worker above the flooring, a frame comprised of vertical and horizontal support members, a flexible water impermeable top carried by the frame and side curtains, preferably formed of a plurality of depending adjacent plastic strips, are carried by an upper portion of the frame so as to extend between the upper and lower portions of the frame, preferably on at least three full sides of the station. The heat exchanger extends through the open side of the station where the worker can hydroblast clean the exchanger tubes without obstruction. The flooring, attached side walls and the curtains defined on the remaining sides of the station will act to substantially contain any back spray within the station while protecting the surrounding area.

Through the aforesaid combination, the heat exchanger tubes can be thoroughly cleaned by a hydroblast process either in a designated cleaning pad area or substantially in place, the water and debris generated by the cleaning process is readily contained and collected for disposal and the individual conducting the hydroblast cleaning is maintained in a substantially protected environment. The entire assembly is lightweight and portable for use in industrial plants with tightly spaced equipment.

DESCRIPTION OF THE PREFERRED EMBODIMENTS

Figure 1:
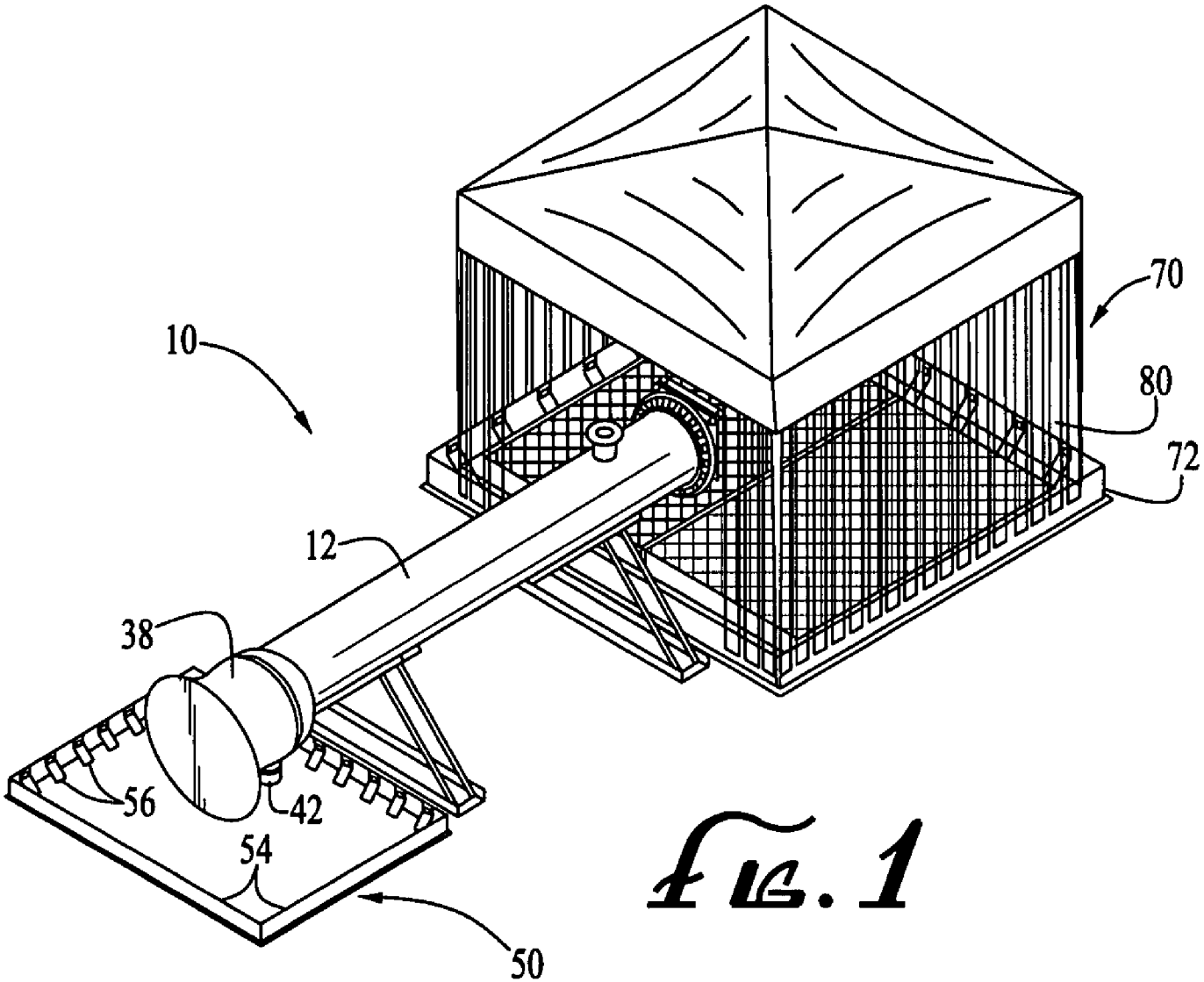
FIG. 1 is a perspective view illustrating the components of the cleaning assembly of the present invention and a common heat exchanger mounted on stands.

Referring now in detail to the drawings, the cleaning assembly 10 of the present invention is illustrated in use in the drawings in connection with the hydroblast cleaning of the flow tubes in a conventional cylindrical heat exchanger 12 (the interior flow tubes, baffles, support plates, etc. not being shown and the front and rear heads removed). The heat exchanger 12 defines a rear or upstream end 14, a forward or downstream end 16, and end flanges 14*a* and 16*a*. It is to be noted that the terms upstream end and downstream end are used herein with reference to the direction of the hydroblast cleaning spray as many heat exchangers are symmetrical with their front and rear heads removed, thus allowing the cleaning assembly 10 of the present invention to be secured to either end of the heat exchanger for cleaning the tubes therein.

In the embodiment of the invention illustrated in the drawings, the cleaning assembly 10 includes an energy absorbing element 18 for reducing the force of water jets exiting the heat exchanger. Further experimentation with cleaning assembly 10 may indicate that the use of an energy absorbing element in the assembly is not necessary. If included, the element absorbing element 18 can be of a variety of different configurations and is mounted on the downstream end flange 16*a* of the heat exchanger so as to be adjacent the downstream end 16 of the heat exchanger. In the presently preferred embodiment, the energy absorbing element 18 is mounted on the end flange 16*a* by means of a plurality of elongated threaded metal rods 20 which extend through apertures disposed in end flange 16*a* and are secured by threaded fasteners 22 (preferably wing nuts) adjacent the upstream end of flange 16*a*. The rods 20 project downstream from the end flange 16*a* in a parallel array. In its preferred configuration, the energy absorbing element 18 comprises a plurality of depending flexible ropes formed of a nylon or other suitable material secured at their upper end to a horizontally disposed angle iron 24 provided with two laterally spaced apertures 24*a* therein adapted to receive portions of the two upper rods 20 such that the energy absorbing element 18 can be mounted thereon and extend across the downstream end of the heat exchanger. Other forms of energy absorbing elements could include but are not limited to perforated metal panels and wire mesh screens.

A circular containment shield 26, preferably formed of a durable plastic material is mounted on rods 20 downstream of the energy absorbing element 18. Shield 26 can be square, circular or of any other desired shape and defines a transverse dimension substantially equal to the diameter of the end flange 16*a* on the heat exchanger. Differently sized shields and energy absorbing elements would be provided for differently sized heat exchangers. Shield 26 is provided with apertures 26*a* therein for receiving the downstream end portions of mounting rods 20 to effect the mounting of the containment shield in axial alignment with the energy absorbing element 18 and the central axis of the heat exchanger 12. The containment shield 26 is secured in place by fasteners 22 (e.g. wing nuts) that threadably engage rods 20 thereby fixing the shield 26 and energy absorbing element 18 in axial alignment. Rods 20 are preferably formed of about 0.25 inch diameter threaded steel rods and thus provide inherent flexibility to accommodate the mounting of the shield and energy absorbing element in substantial alignment.

A relatively thin and flexible water-impermeable sheet 30, preferably formed of galvanized steel and having an axial length of about 12-18 in., depending on the size of the unit, is wrapped about rods 20 between the containment shield 26 and the energy absorbing element 18 and secured in a cylindrical disposition by straps 32 and buckles 34 so as to provide an annular shield that cooperates with the end shield 26 to substantially contain the spray and debris passing through the heat exchanger tubes during cleaning. It is to be understood that any suitable fastener could be employed to releasably secure sheet 30 about rods 20. Alternatively, the end and annular containment shields 26 and 30 could be formed of a single-piece construction. An aperture 36, approximately 4 inches in diameter, is formed in sheet 30 so as to be positioned at the bottom of the annular shield upon the sheet being secured in a cylindrical configuration about rods 20 so as to define a drain for the water and debris.

Figure 4:
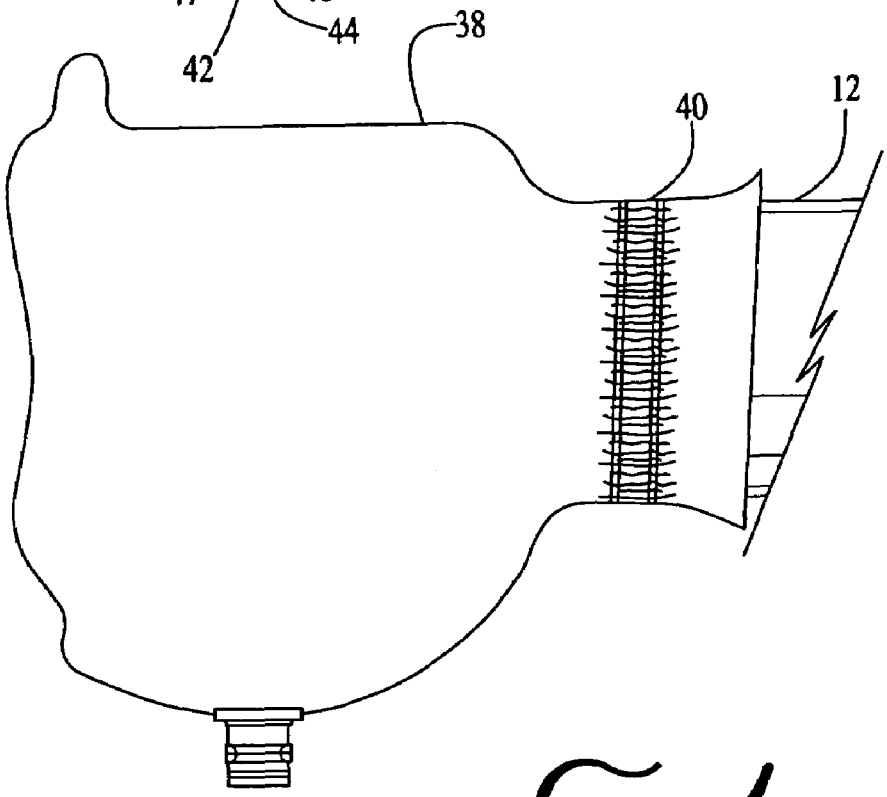
FIG. 4 is a side view illustrating the portion of the cleaning assembly of the present invention secured about the downstream end of the heat exchanger.

A containment cover or shroud 38, preferably formed of an 18 oz. vinyl so as to render the cover flexible and waterproof, is disposed about end shield 26, the annular shield 30, the energy absorbing element 18, the end flange 16*a* on the heat exchanger and a portion of the downstream end of the heat exchanger. An elastic band 40 is preferably formed in the upstream portion of shroud 38 so as to secure the cover in place about the downstream body portion of the heat exchanger as best seen in FIG. 4. A drain element 42 defining a lower outlet tube 44 having a cam lock fitting 46 formed thereon is secured to the lower end of the shroud about an aperture formed therein by an upper tube extension 47 and a flanged nut 48. The upper tube extension 47 threadably engages an upper end portion of the tube 44 and projects upwardly therefrom through the aperture in the shroud. Flange nut 48 threadably engages the portion of the upper tube extension 47 on the inside of the adjacent portion of the shroud so as to sandwich the portion of the shroud surrounding the aperture therein between extension 47 and the flanged nut 48, securing the drain element 42 in place. A gasket and large plastic washer (not shown) are preferably positioned about the aperture in the shroud on opposed sides of the shroud to provide a watertight seal and to prevent damaging the shroud material upon tightening the nut onto the upper tube extension. The cam lock fitting 46 on the outlet tube allows for the rapid attachment of a flexible drainage hose for directing the water and debris to a desired collection point.

Figure 2:
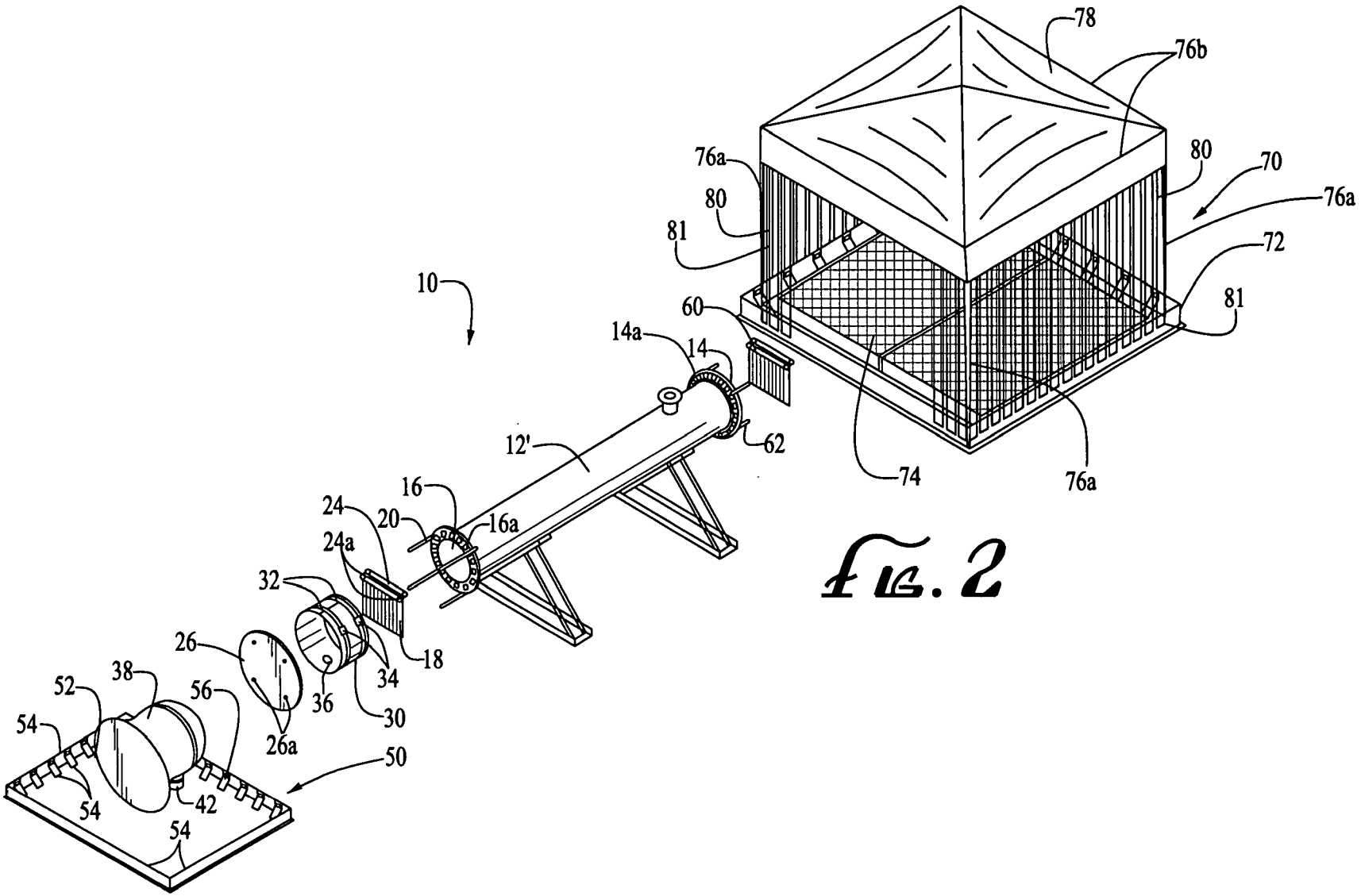
FIG. 2 is an exploded perspective view illustrating the components of the cleaning assembly of the present invention and a common heat exchanger mounted on stands.
Figure 3:
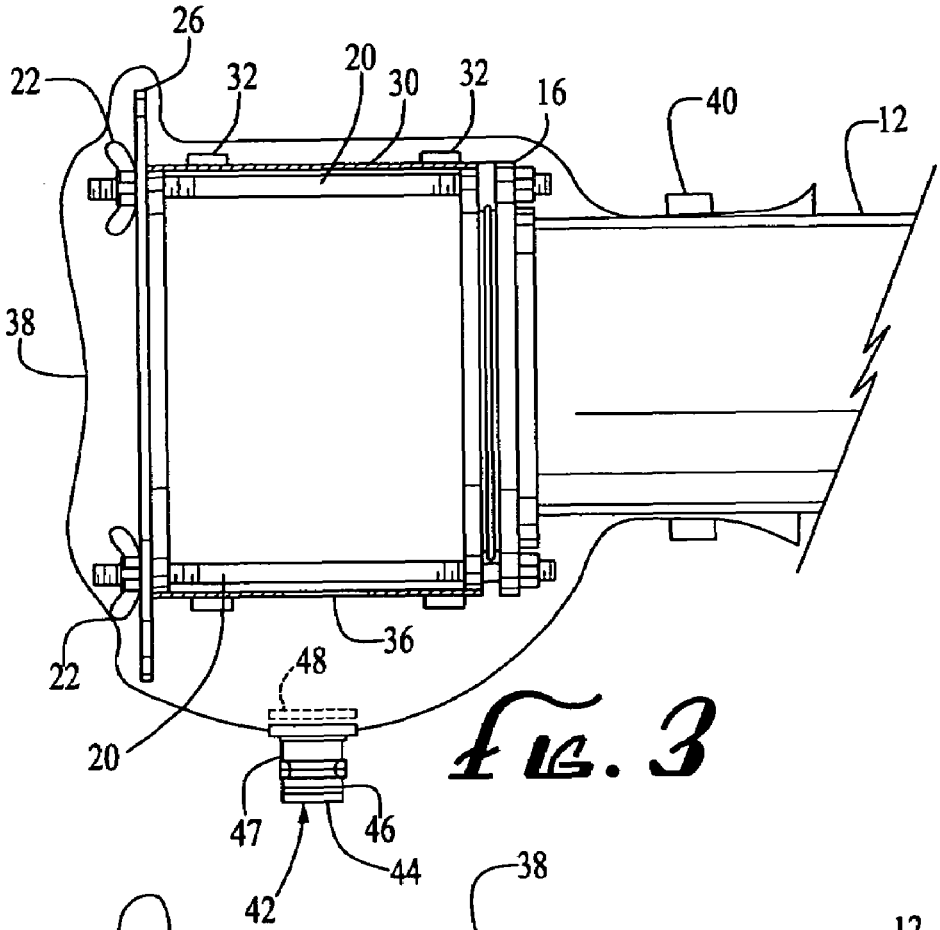
FIG. 3 is a sectional view illustrating the portion of the cleaning assembly of the present invention secured about the downstream end of the heat exchanger.
Figure 5:
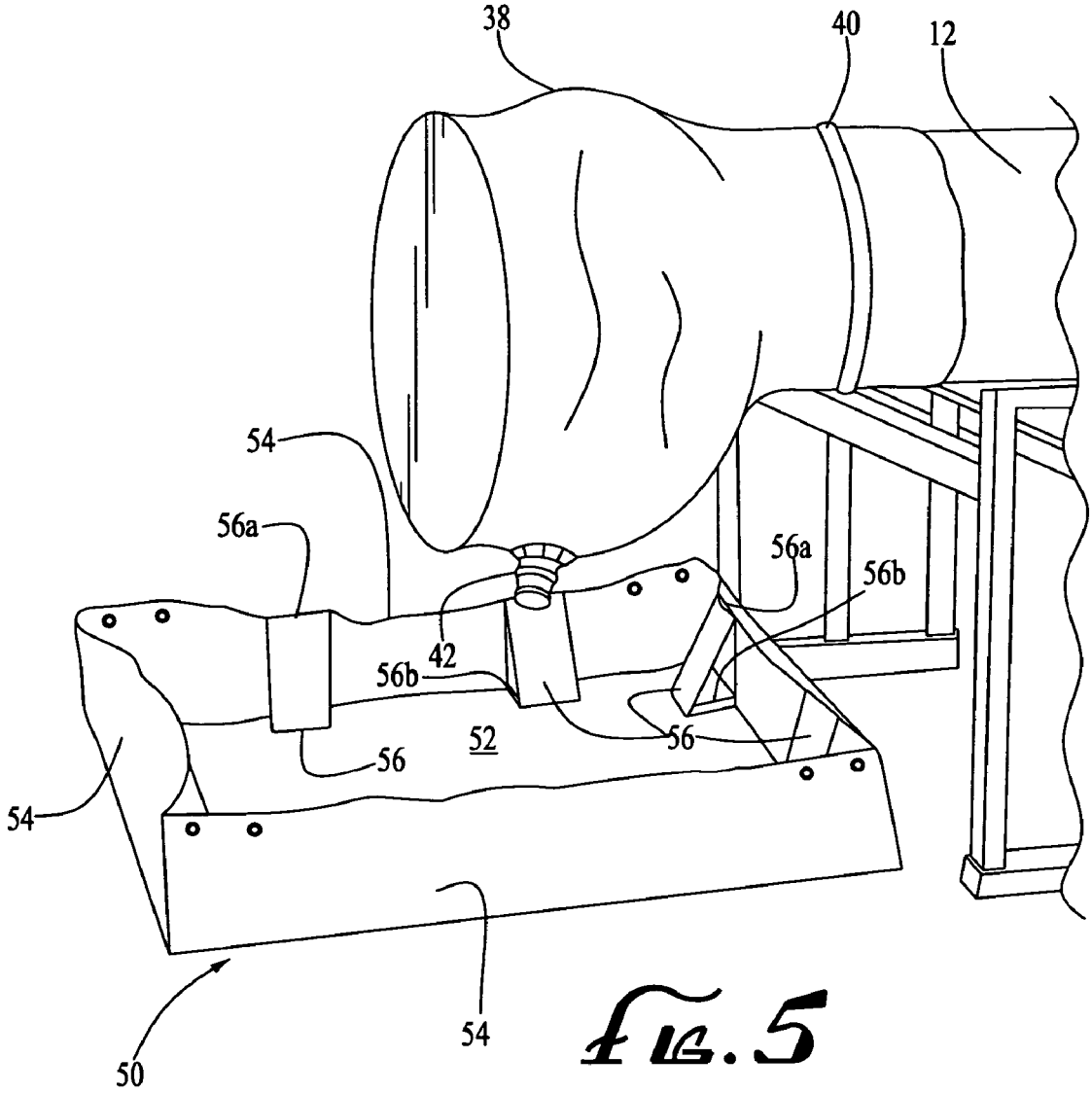
FIG. 5 is an enlarged perspective view of the assembly of the present invention secured about the downstream end of a heat exchanger and the containment berm disposed therebelow.

In one embodiment of the present invention (see FIGS. 1 and 2), the collection point is defined by a portable containment berm 50. The containment berm 50 is preferably formed of a durable and flexible plastic material and defines a horizontal bottom surface 52 adapted to rest on the ground directly below the downstream end of the heat exchanger. The berm 50 also includes a plurality of upstanding wall portions 54 which are foldable between a flat horizontal disposition parallel with the floor portion 52 and a vertical upright position. Inverted "V"-shaped supports 56 provided with stiffeners therein extend between the floor and wall portions for maintaining the wall portions in an upright disposition. Supports 56 each extend upwardly from a wall portion 54 at one end thereof and inwardly from the wall portion to a fold 56*a* and downwardly therefrom to the floor surface 52 where the supports define an extending horizontal foot portion 56*b* as seen in FIG. 5. Such a device is marketed by Basic Concepts, Inc., located in Anderson, S.C., under the name QuickBerm. Such a configuration provides a lightweight and extremely portable spill containment berm for collecting the affluent from the shroud 38 of the cleaning assembly 10. Other collection devices could, of course, be employed. Alternatively, a flexible hose provided with a cam lock fitting (not shown) that is adapted to interlock with the fitting 46, tube outlet 44 can be employed for directing the water and debris passing through the drain element 42 in the bottom of shroud 38 to a collection site.

If desired, a second energy absorption element 60 can be mounted on a similarly positioned plurality of horizontal extending rods 62 carried by the upstream end flange 14*a* of the heat exchanger 12 such that element 60 is spaced from and axially aligned with the upstream end of the heat exchanger. Element 60 would preferably be of the same configuration as energy absorbing element 18 although other configurations and mountings could be employed. Element 60 would allow the hydroblasting wand to be inserted between the depending ropes or other elements thereon by the operator, allow the operator to freely move the wand during cleaning and absorb the energy of any high velocity spray bouncing off the heat exchanger and back towards the operator. Element 60 would also deflect some of the back spray away from the operator.

A portable lightweight washing station 70 is preferably provided at the upstream end of the heat exchanger for collecting the back spray deflected off the heat exchanger during cleaning. In its preferred configuration, the station 70 is of a generally square configuration and is positioned on a second spill containment berm 72, substantially identical to containment berm 50, and additionally includes an elevated grid walkway 74 preferably formed of a plastic or other lightweight durable material and elevated slightly above the flooring of containment berm 72. The washing station 70 has a lightweight frame 76 comprising vertical and horizontal elements 76*a* and 76*b*, a plastic lightweight cover 78 and a plurality of adjacent curtains 80 hanging from an upper portion of frame 76 so as to extend about at least three of the sides of the station 70. Curtains 80 preferably are each comprised of a plurality of depending plastic strips 81 hanging in close disposition so as to define the curtains. Alternatively, and more economically, each curtain could be formed of a single sheet of plastic material, preferably having a vertical slit provided therein for access to the interior of the station through the sides or rear thereof. The slits could be left open or be provided with a zipper closure. Such embodiments would be more economical than the use of adjacent plastic strips 81 and could be disposable.

Station 70 is positioned such that the upstream end 14 of the heat exchanger extends into the interior of the station through the open side not covered by curtains 80. If desired, depending plastic strips or narrow curtains could be extended across lateral portions of the open end of the shelter, leaving a portion of that side of the shelter open so that the end 14 of the heat exchanger can extend therethrough unimpeded by the plastic strips or curtains. So positioned, the station 70 allows the worker to stand within the shelter while he or she directs the high velocity water spray from the hydroblasting cleaning wand into the heat transfer tubes. The return spray bouncing off of the heat exchanger or the components thereof is then largely retained within the station 70, protecting the surrounding area from the water and debris. Preferably, the plastic curtains extending about the sides of the washing station is defined by thin rectangular vinyl strips approximately 6 inches wide by 0.060 inches thick.

Various changes and modifications can be made in carrying out the present invention without departing from the spirit and scope thereof. Insofar as these changes and modifications are within the purview of the appended claims, they are to be considered as part of the present invention.

What is claimed is:

1. An assembly for use in the collection and disposal of water and debris during the hydroblast cleaning of a heat exchanger using an elongated water discharge wand, said assembly comprising:

a first containment shield mountable proximate one end of a heat exchanger so as to be spaced therefrom and in substantial axial alignment therewith;

a second containment shield disposed in a cylindrical configuration for positioning between the one end of the heat exchanger and said first shield so as to circumscribe an area therebetween, said second containment shield defining a drain aperture therein; and a flexible waterproof shroud adapted to be disposed about said first and second containment shields and a portion of the heat exchanger for containing waste and debris passing through said drain aperture in said second containment shield during the hydroblast cleaning of the heat exchanger, said shroud defining a drain outlet therein for directing water and debris to a collection location.

2. The assembly of claim 1 including an energy absorbing element at least a portion of which is flexible, said element being mountable adjacent said one end of a heat exchanger.

3. The assembly of claim 2 including a portable and collapsible containment berm adapted to be positioned on the ground below said shroud for the collection of water and debris passing through said drain outlet in said shroud.

4. The assembly of claim 2 including a portable washing station adapted to be disposed about a second end of the heat exchanger for containing back spray off the heat exchanger during the hydroblast cleaning thereof, said station comprising a liquid impervious flooring disposed below the second end of the heat exchanger, collapsible lower side walls projecting upwardly from said flooring, a frame defining a plurality of sides disposed within said lower side walls, a waterproof upper cover carried by said frame, and a plurality of flexible curtains carried by said frame and depending therefrom so as to extend across at least three of said sides.

5. The assembly of claim 4 wherein at least one of said sides of said station is at lest partially open for receiving the second end of the heat exchanger therethrough.

6. The assembly of claim 1 including a plurality of rods adapted to be secured to the one end of said heat exchanger so as to project therefrom in a parallel array, said containment shields being carried by said rods.

7. The assembly of claim 1 including a portable and collapsible containment berm adapted to be positioned on the ground below said shroud for the collection of water and debris passing through said drain outlet in said shroud.

8. The assembly of claim 1 wherein said drain outlet in said shroud comprises an upper tubular portion, a lower tubular portion in fluid communication with said upper tubular portion, said upper tubular portion extending through an aperture in said shroud and communicating with the interior of said shroud, and an attachment member engaging said upper tubular portion within said shroud so as to sandwich a portion of said shroud therebetween thereby sealably securing said drain outlet to said shroud and wherein said lower tubular portion defines a surface thereon for the securement thereto of an outlet hose.

9. The assembly of claim 8 wherein said attachment member threadably engages said upper tubular portion of said drain outlet and said lower tubular portion of said drain outlet defines a cam lock.

10. The assembly of claim 1 including a portable washing station adapted to be disposed about a second end of the heat exchanger for containing back spray off the heat exchanger during the hydroblast cleaning thereof, said station comprising a liquid impervious flooring disposed below the second end of the heat exchanger, collapsible lower side walls projecting upwardly from said flooring, a frame defining a plurality of sides disposed within said lower side walls, a waterproof upper cover carried by said frame, and a plurality of flexible curtains carried by said frame and depending therefrom so as to extend across at least three of said sides.

11. The assembly of claim 10 wherein at least one of said sides of said station is at lest partially open for receiving the second end of the heat exchanger therethrough.

12. The assembly of claim 1 including an energy absorbing element at least a portion of which is flexible and allows water flow therethrough, said element being mountable adjacent said one end of a heat exchanger.

13. An assembly for use in the collection and disposal of water and debris during the hydroblast cleaning of a heat exchanger using an elongated water discharge wand, said assembly comprising:

a first containment shield mountable proximate one end of a heat exchanger so as to be spaced therefrom and in substantial axial alignment therewith;

a second containment shield disposed in a cylindrical configuration for positioning between the one end of the heat exchanger and said first shield so as to circumscribe an area therebetween, said second containment shield defining a drain aperture therein;

a flexible waterproof shroud adapted to be disposed about said first and second containment shields and a portion of the heat exchanger for containing waste and debris passing through said drain aperture in said second containment shield during the hydroblast cleaning of the heat exchanger, said shroud defining a drain outlet therein for directing water and debris to a collection location; and an energy absorbing element at least a portion of which is flexible, said element being mounted adjacent said one end of a heat exchanger, said energy absorbing element comprising a laterally extending support member mountable on the one end of the heat exchanger and a plurality of flexible energy absorbing members carried by and depending from said laterally extending support member, said depending flexible members absorbing energy from the water spray passing through the heat exchanger during hydroblast cleaning so as to protect said shroud.

14. The assembly of claim 13 wherein said energy absorbing members comprise lengths of rope.

15. The assembly of claim 13 including a second energy absorption element comprising a plurality of depending flexible energy absorption members and being mountable proximate a second end of the heat exchanger and in substantial axial alignment therewith for absorbing a portion of the energy of the back spray off the heat exchanger during cleaning and deflecting the back spray while allowing for the extension of the hydroblast discharge wand therethrough during the hydroblast cleaning and the movement of the wand while extending therethrough.

16. The assembly of claim 13 including a portable washing station adapted to be disposed about a second end of the heat exchanger for containing back spray off the heat exchanger during the hydroblast cleaning thereof, said station comprising a liquid impervious flooring disposed below the second end of the heat exchanger, collapsible lower side walls projecting upwardly from said flooring, a frame defining a plurality of sides disposed within said lower side walls, a waterproof upper cover carried by said frame, and a plurality of flexible curtains carried by said frame and depending therefrom so as to extend across at least three of said sides.

17. The assembly of claim 16 wherein said curtains comprise a plurality of adjacent flexible strips of plastic material.

18. An assembly for use in the collection and disposal of water and debris during the hydroblast cleaning of a heat exchanger using an elongated water discharge wand, said assembly comprising:

a first containment shield mountable proximate one end of a heat exchanger so as to be spaced therefrom and in substantial axial alignment therewith;

a second containment shield disposed in a cylindrical configuration for positioning between the one end of the heat exchanger and said first shield so as to circumscribe an area therebetween, said second containment shield defining a drain aperture therein;

a flexible waterproof shroud adapted to be disposed about said first and second containment shields and a portion of the heat exchanger for containing waste and debris passing through said drain aperture in said second containment shield during the hydroblast cleaning of the heat exchanger, said shroud defining a drain outlet therein for directing water and debris to a collection location;

an energy absorbing element at least a portion of which is flexible, said element being mounted adjacent said one end of a heat exchanger; and a plurality of rods adapted to be secured to the one end of said heat exchanger so as to project therefrom in a parallel array, said energy absorbing element and said containment shields being carried by said rods.

19. The assembly of claim 18 wherein said second containment shield comprises a flexible sheet wrapped about said rods and including attachment members for maintaining said sheet in a cylindrical configuration about said rods and said area between said energy absorbing element and said first containment shield.

20. The assembly of claim 18 wherein said energy absorbing element comprises a laterally extending support member mountable on the one end of the heat exchanger and a plurality of flexible energy absorbing members carried by and depending from said laterally extending support member, said depending flexible members absorbing energy from any return spray deflected off the heat exchanger during hydroblast cleaning while allowing for the extension of the hydroblast discharge wand therethrough and the movement of the wand while extending therethrough.

21. An assembly for use in the collection and disposal of water and debris during the hydroblast cleaning of a heat exchanger using an elongated water discharge wand, said assembly comprising:

a first containment shield mountable proximate one end of a heat exchanger so as to be spaced therefrom and in substantial axial alignment therewith;

a second containment shield disposed in a cylindrical configuration for positioning between the one end of the heat exchanger and said first shield so as to circumscribe an area therebetween, said second containment shield defining a drain aperture therein;

a flexible waterproof shroud adapted to be disposed about said first and second containment shields and a portion of the heat exchanger for containing waste and debris passing through said drain aperture in said second containment shield during the hydroblast cleaning of the heat exchanger, said shroud defining a drain outlet therein for directing water and debris to a collection location; and a plurality of rods adapted to be secured to one end of said heat exchanger so as to project therefrom in a parallel array, said containment shields being carried by said rods and wherein said second containment shield comprises a flexible sheet wrapped about said rods and including attachment members for maintaining said sheet in a cylindrical configuration about said rods and said area between said energy absorbing element and said first containment shield.

22. An assembly for use in the collection and disposal of water and debris during the hydroblast cleaning of a heat exchanger using an elongated water discharge wand, said assembly comprising:

a first containment shield mountable proximate one end of a heat exchanger so as to be spaced therefrom and in substantial axial alignment therewith;

a second containment shield disposed in a cylindrical configuration for positioning between the one end of the heat exchanger and said first shield so as to circumscribe an area therebetween, said second containment shield defining a drain aperture therein;

a flexible waterproof shroud adapted to be disposed about said first and second containment shields and a portion of the heat exchanger for containing waste and debris passing through said drain aperture in said second containment shield during the hydroblast cleaning of the heat exchanger, said shroud defining a drain outlet therein for directing water and debris to a collection location;

an energy absorbing element at least a portion of which is flexible, said element being mountable adjacent said one end of said heat exchanger; and a second energy absorption element comprising a plurality of depending flexible energy absorption members and being mountable proximate a second end of the heat exchanger and in substantial axial alignment therewith for absorbing a portion of the energy of the back spray off the heat exchanger during cleaning and deflecting the back spray while allowing for the extension of the hydroblast discharge wand therethrough during the hydroblast cleaning and the movement of the wand while extending therethrough.

23. An assembly for use in the collection and disposal of water and debris during the hydroblast cleaning of a heat exchanger using an elongated water discharge wand, said assembly comprising:

a first containment shield mountable proximate one end of a heat exchanger so as to be spaced therefrom and in substantial axial alignment therewith;

a second containment shield disposed in a cylindrical configuration for positioning between the one end of the heat exchanger and said first shield so as to circumscribe an area therebetween, said second containment shield defining a drain aperture therein;

a flexible waterproof shroud adapted to be disposed about said first and second containment shields and a portion of the heat exchanger for containing waste and debris passing through said drain aperture in said second containment shield during the hydroblast cleaning of the heat exchanger, said shroud defining a drain outlet therein for directing water and debris to a collection location;

an energy absorbing element at least a portion of which is flexible, said element being mountable adjacent said one end of said heat exchanger;

a portable washing station adapted to be disposed about a second end of the heat exchanger for containing back spray off the heat exchanger during the hydroblast cleaning thereof, said station comprising a liquid impervious flooring disposed below the second end of the heat exchanger, collapsible lower side walls projecting upwardly from said flooring, a frame defining a plurality of sides disposed within said lower side walls, a waterproof upper cover carried by said frame, and a plurality of flexible curtains carried by said frame and depending therefrom so as to extend across at least three of said sides; and a second energy absorption element comprising a plurality of depending flexible energy absorption members and being mountable proximate a second end of the heat exchanger and in substantial axial alignment therewith for absorbing a portion of the energy of the back spray off the heat exchanger during cleaning and deflecting the back spray while allowing for the extension of the hydroblast discharge wand therethrough during the hydroblast cleaning and the movement of the wand while extending therethrough.

* * * * *